US012173566B2

(12) United States Patent
von Gynz-Rekowski et al.

(10) Patent No.: US 12,173,566 B2
(45) Date of Patent: Dec. 24, 2024

(54) OSCILLATION REDUCTION TOOL AND METHOD

(71) Applicant: Rival Downhole Tools LC, Houston, TX (US)

(72) Inventors: Gunther H H von Gynz-Rekowski, Montgomery, TX (US); Steven Samuel Mitchell, Scottsdale, AZ (US); William Christian Herben, Magnolia, TX (US)

(73) Assignee: Rival Downhole Tools LC, Houston, TX (US)

( * ) Notice: Subject to any disclaimer, the term of this patent is extended or adjusted under 35 U.S.C. 154(b) by 25 days.

(21) Appl. No.: 17/965,951

(22) Filed: Oct. 14, 2022

(65) Prior Publication Data

US 2023/0124872 A1 Apr. 20, 2023

Related U.S. Application Data

(60) Provisional application No. 63/256,171, filed on Oct. 15, 2021.

(51) Int. Cl.
*E21B 17/07* (2006.01)
*E21B 7/04* (2006.01)

(52) U.S. Cl.
CPC ..... *E21B 17/076* (2013.01); *E21B 7/04* (2013.01); *E21B 17/07* (2013.01); *E21B 17/073* (2013.01)

(58) Field of Classification Search
CPC ..... E21B 17/07; E21B 17/073; E21B 17/076; E21B 7/04
See application file for complete search history.

(56) References Cited

U.S. PATENT DOCUMENTS 4,254,837 A 3/1981 Jones
4,571,215 A * 2/1986 Hansen ..... F16F 15/10 267/141.1
4,901,806 A 2/1990 Forrest
6,308,940 B1 10/2001 Anderson
6,543,556 B1 4/2003 Anderson
6,808,455 B1 * 10/2004 Solorenko ..... F16F 15/124 464/83
6,997,271 B2 2/2006 Nichols et al.
(Continued)

OTHER PUBLICATIONS

International Search Report and Written Opinion dated Jan. 31, 2023, from Applicant's counterpart International Patent Application No. PCT/US2022/46671.

*Primary Examiner* — D. Andrews
(74) *Attorney, Agent, or Firm* — Jones Walker LLP

(57) ABSTRACT

An oscillation reduction tool configured to prevent or reduce high frequency torsional oscillation by torsionally decoupling a rotary steerable system from a bottom hole assembly, which includes a drilling motor. The tool may convert high frequency torsional oscillation into an internal axial movement without axial displacement of the tool's outer housing. The oscillation reduction tool may flatten an amplitude of high frequency torsional oscillation spikes throughout a spring arrangement. The mechanical energy associated with the internal axial movement is reduced through an internal shock absorbing mechanism, such as fluid movement through a nozzle or annular space. The oscillation reduction tool functions to reduce high frequency torsional oscillation independent of the weight on the bit of the drill string.

18 Claims, 15 Drawing Sheets

(56) References Cited

U.S. PATENT DOCUMENTS

| | | | | |
|---|---|---|---|---|
| 7,044,240 | B2 | 5/2006 | McNeilly | |
| 7,578,360 | B2 | 8/2009 | Haughom | |
| 7,654,344 | B2 | 2/2010 | Haughom et al. | |
| 9,109,410 | B2 * | 8/2015 | Swietlik | E21B 17/07 |
| 10,443,321 | B2 | 10/2019 | Cravatte et al. | |
| 10,533,376 | B2 | 1/2020 | Reimers | |
| 11,142,962 | B2 | 10/2021 | Simanowski et al. | |
| 2007/0000695 | A1 * | 1/2007 | Laflin | E21B 17/073 175/57 |
| 2011/0198126 | A1 | 8/2011 | Swietlik et al. | |
| 2012/0103689 | A1 | 5/2012 | Hutchinson | |
| 2015/0376959 | A1 | 12/2015 | Dinica et al. | |
| 2021/0189806 | A1 | 6/2021 | Simanowski et al. | |
| 2022/0403731 | A1 | 12/2022 | Johnson | |
| 2023/0009235 | A1 | 1/2023 | Kulke et al. | |

* cited by examiner

OSCILLATION REDUCTION TOOL AND METHOD

CROSS-REFERENCE TO RELATED APPLICATION

This application claims the benefit of and priority to U.S. Provisional Patent Application No. 63/256,171, filed on Oct. 15, 2021, which is incorporated herein by reference in its entirety.

BACKGROUND

In the process of drilling subterranean wellbores using a rotary steerable system and a positive displacement drilling motor, high frequency torsional oscillation ("HFTO") takes place due to a self-excited torsional vibration of the bottom hole assembly caused by the interaction of the drill bit with the subterranean formation through which the well is drilled. When the drill bit stops rotating, the drilling motor applies an increased torque to the drill bit until the torque on the drill bit overcomes the cutting forces to allow the drill bit to rotate again. This process is repeated mostly at a frequency between 80 and 150 Hz, which causes damage especially to the rotary steerable system.

Attempts have been made to reduce HFTO by placing a dampener between the drilling motor and the drill bit. However, these prior art devices only dampen the mechanical energy of the HFTO; they do not absorb or reduce the mechanical energy of the HFTO.

There is a need for a device that dampens and simultaneously reduces the mechanical energy of HFTO near rotary steerable systems in drill strings.

BRIEF DESCRIPTION OF THE DRAWING VIEWS

DETAILED DESCRIPTION OF SELECTED EMBODIMENTS

Disclosed herein is an oscillation reduction tool configured to prevent or reduce HFTO by torsionally decoupling a rotary steerable system ("RSS") from the positive displacement drilling motor. The tool may convert HFTO into an internal axial movement without axial displacement of the tool's outer housing. The oscillation reduction tool may flatten an amplitude of HFTO spikes throughout a spring arrangement. The mechanical energy associated with the internal axial movement is reduced through an internal shock absorbing mechanism, such as fluid movement through a nozzle or annular space. The oscillation reduction tool functions to reduce HFTO independent of the weight on the bit ("WOB") of the drill string.

Figure 1:
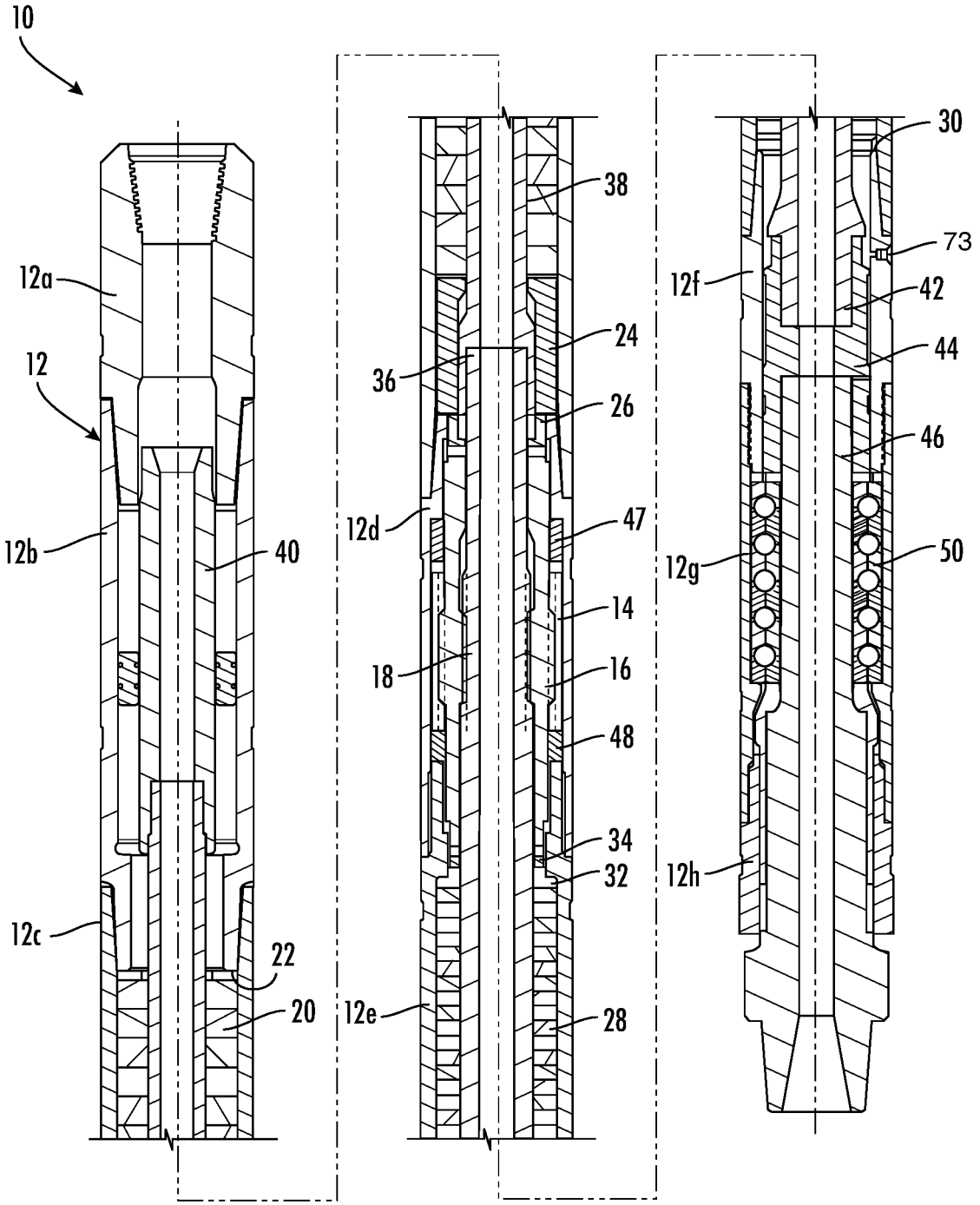
FIG. 1 is a sectional view of an oscillation reduction tool.
Figure 2:
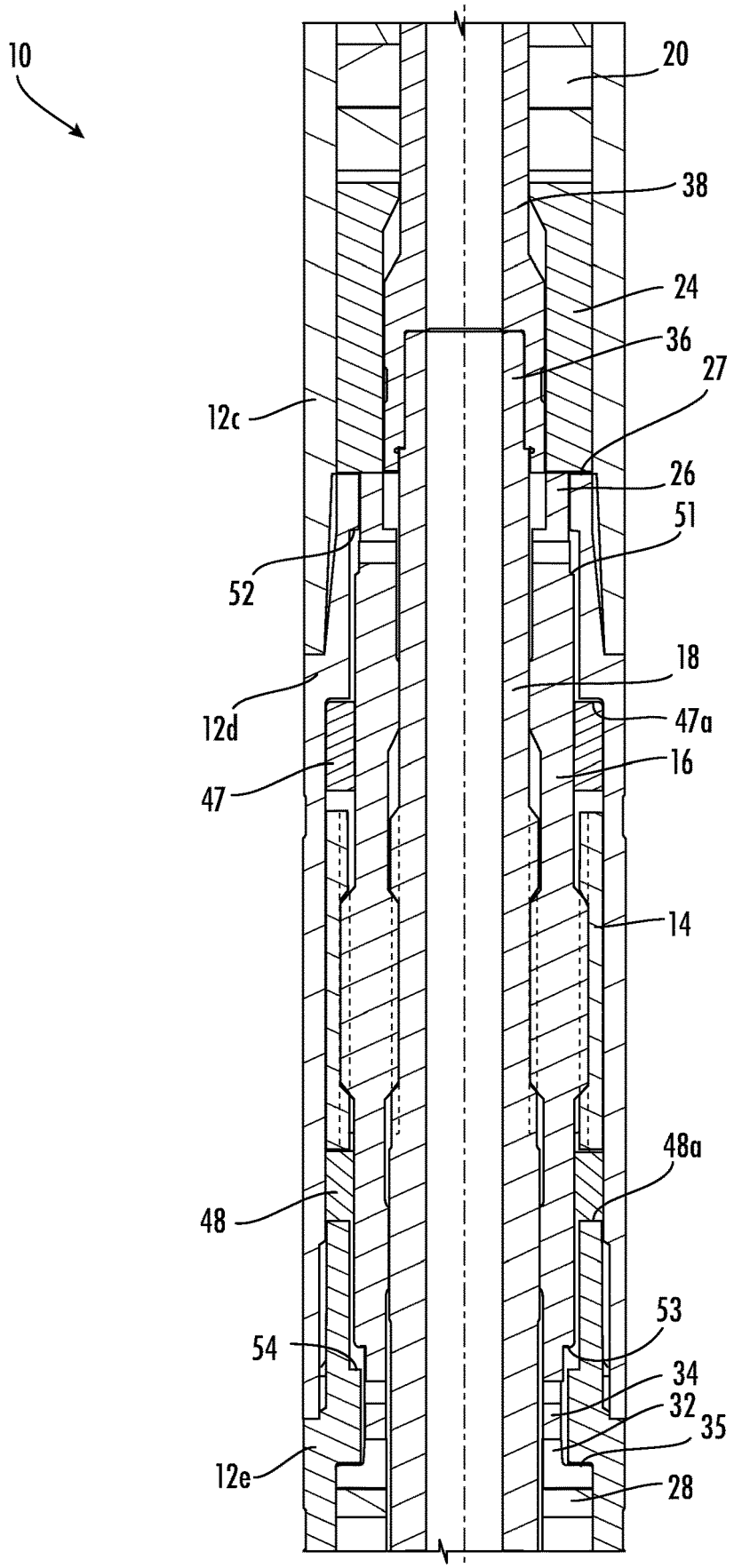
FIG. 2 is a partial sectional view of a torque adjustment assembly of the oscillation reduction tool in a default position.

With reference to FIGS. 1 and 2, oscillation reduction tool 10 includes outer housing 12. In some embodiments, outer housing 12 may include two or more segments, such as outer housing segments 12*a*-12*h* threadedly secured together. Outer housing 12 may be adapted to be secured to a tubular string as an element of the bottom hole assembly, which also includes a drilling motor. In one example the outer housing 12 is configured to be directly or indirectly attached below a positive displacement mud motor.

A torque adjustment assembly may be disposed within a central bore of outer housing 12. The torque adjustment assembly may include spline sleeve 14 disposed within the central bore of outer housing 12, shuttle 16 at least partially disposed within a central bore of the spline sleeve 14, and mandrel 18 at least partially disposed through shuttle 16. The torque adjustment assembly may also include upper spring 20 disposed between downward facing shoulder 22 of outer housing 12 and upper spring block 24, which selectively engages upper end 26 of shuttle 16. Upper spring 20 may be configured to bias shuttle 16 in a downstream direction up to a stopping point at which upper spring block 24 engages a shoulder of outer housing 12, such as shoulder 27 formed by an upper end of outer housing segment 12*d*. The torque adjustment assembly may further include lower spring 28 disposed between upward facing shoulder 30 of outer housing 12 and lower spring block 32, which selectively engages lower end 34 of shuttle 16. Lower spring 28 may be configured to bias shuttle 16 in an upstream direction up to a stopping point at which lower spring block 32 engages a shoulder of outer housing 12, such as shoulder 35 of outer housing segment 12*e*.

Upper end 36 of mandrel 18 may be threadedly attached to a lower end of first upper mandrel segment 38, which may in turn be threadedly attached to a lower end of second upper mandrel segment 40. First upper mandrel segment 38 may be disposed through a central bore of upper spring 20 and upper spring block 24. Mandrel 18 may be disposed through a central bore of lower spring block 32 and lower spring 28. Lower end 42 of mandrel 18 may be threadedly attached to an upper end of mandrel adapter 44, which may be threadedly attached to an upper end of lower mandrel 46. Lower mandrel 46 may be adapted for direct or indirect attachment to a rotary steerable system and drill bit. A central bore extending through second upper mandrel segment 40, first upper mandrel segment 38, mandrel 18, mandrel adapter 44, and lower mandrel 46 may be configured to allow fluid flow therethrough (e.g., drilling fluid or drilling mud).

Oscillation reduction tool 10 may also include upper radial bearing 47 disposed above spline sleeve 14 and lower radial bearing 48 disposed below spline sleeve 14 within an annular space between outer housing 12 and shuttle 16. Upper and lower radial bearings 47 and 48 may be retained axially by one or more shoulders of outer housing 12. For example, upper radial bearing 47 may be retained by shoulder 47*a* of outer housing 12, and lower radial bearing 48 may be retained by upper end 48*a* of a segment of outer housing 12. Upper and lower radial bearings 47 and 48 may be configured to provide radial positioning of spline sleeve 14 and shuttle 16 within outer housing 12.

Oscillation reduction tool 10 may further include bearing section 50 disposed below mandrel adapter 44 in an annular space between lower mandrel 46 and outer housing 12. Bearing section 50 may be configured to take up an axial load and transmit the weight ("WOB") of the upstream tubular string onto a drill bit that is connected to a lower side of a rotary steerable system, which is directly positioned below the lower mandrel 46. Bearing section 50 may axially secure the mandrel to outer housing 12. In one embodiment, bearing section 50 may be formed of a standard bearing section of a drilling motor, which may include one or more thrust bearings, thrust rings, friction rings, axial supports, radial bearings, any combination of thrust and radial bearings, or any other type of bearing or device configured to support an axial load while allowing relative rotation between the mandrel and the outer housing 12.

FIG. 2 illustrates the torque adjustment assembly in a default position. Spline sleeve 14 may be configured to rotate with outer housing 12, while mandrel 18 is configured to rotate with a drill bit disposed downstream from the oscillation reduction tool 10. Shuttle 16 may be configured to travel axially along mandrel 18 when a torque produced by a drilling motor disposed above tool 10 causes a torque output on the outer housing 12 that is above a preset torque value range. Axial movement of shuttle 16 in the upstream direction may displace upper spring block 24 and a lower end of upper spring 20 in an upstream direction to compress upper spring 20. The axial movement of shuttle 16 within outer housing 12 may be limited in an upstream direction by the interaction of upper shoulder 51 of shuttle 16 with shoulder 52 of outer housing 12. Axial movement of shuttle 16 in a downstream direction may displace lower spring block 32 and an upper end of lower spring 28 in a downstream direction to compress lower spring 28. The axial movement of shuttle 16 within outer housing 12 may be limited in a downstream direction by the interaction of lower shoulder 53 of shuttle 16 with shoulder 54 of outer housing 12.

Figure 3:
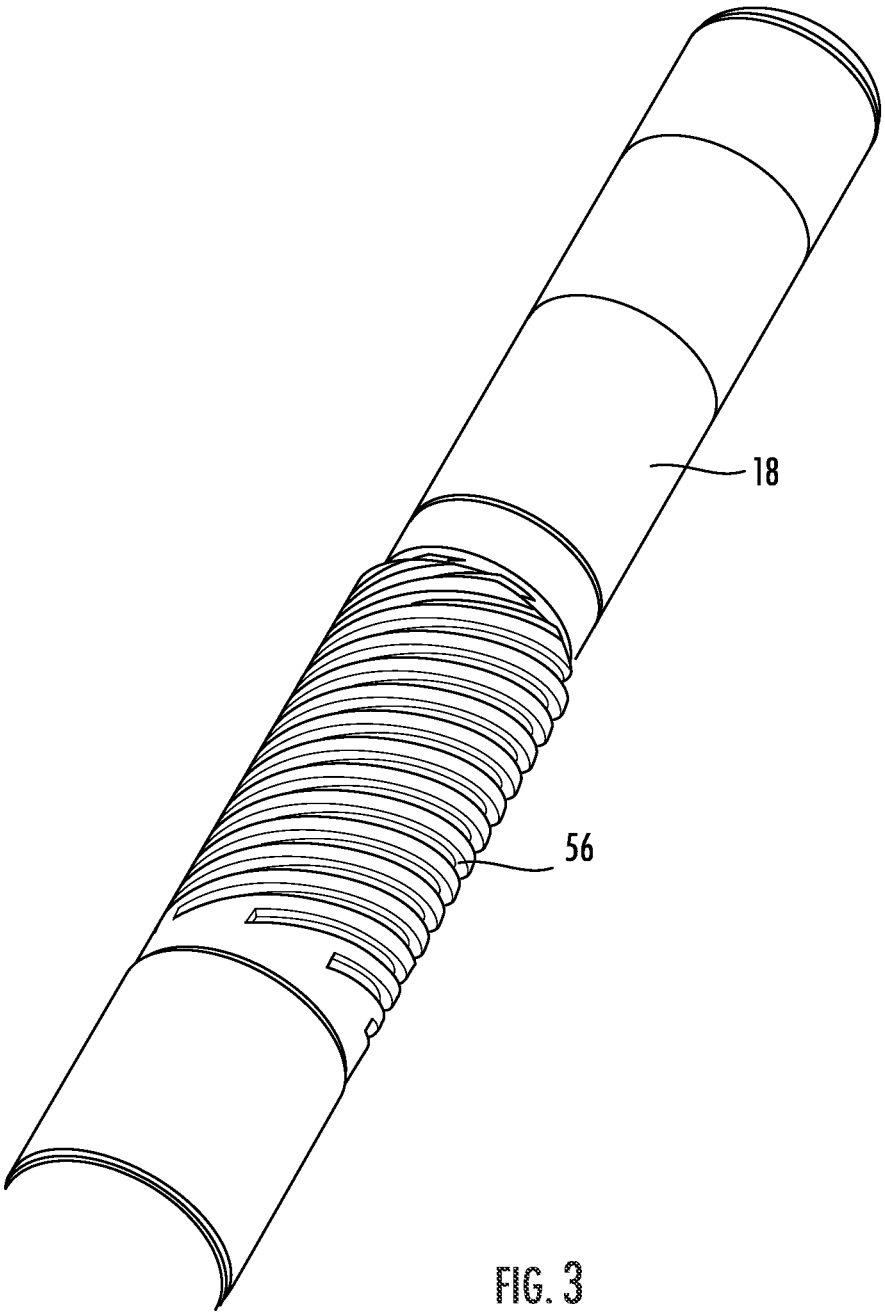
FIG. 3 is a perspective view of a mandrel of the torque adjustment assembly.

With reference to FIG. 3, mandrel 18 may have a generally cylindrical shape. Mandrel 18 may include outer threaded surface 56. In one embodiment, outer threaded surface 56 is formed by a series of spiral recesses in an outer surface of mandrel 18.

Figure 4:
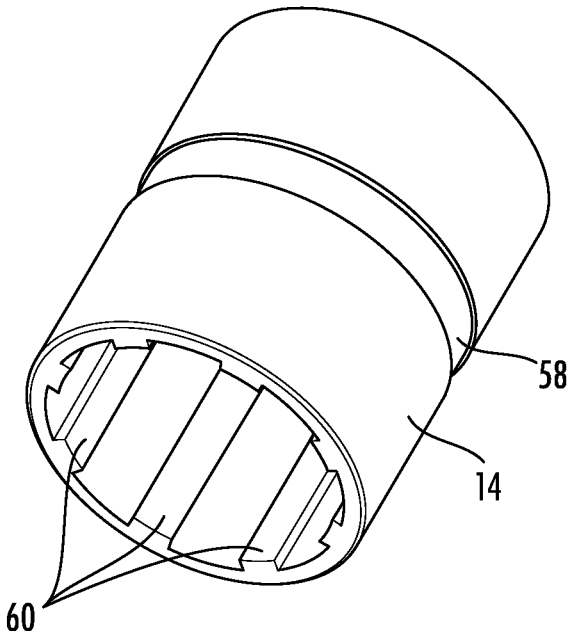
FIG. 4 is a perspective view of a spline sleeve of the torque adjustment assembly.
Figure 5:
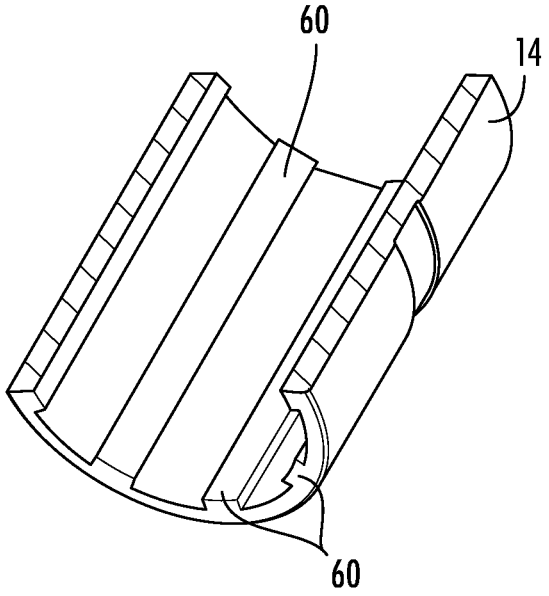
FIG. 5 is a partial perspective view of the spline sleeve.

Referring to FIGS. 4 and 5, spline sleeve 14 may have a generally cylindrical shape. Optionally, spline sleeve 14 may include a recessed circumferential section 58 in its outer surface, which is configured to display identification markings, such as a serial number or a part number of the spline sleeve 14. Spline sleeve 14 may also include internal splines 60. As shown in FIG. 2, spline sleeve 14 is rotationally and axially fixed to outer housing segment 12*d* via compression of outer housing segments 12*c* and 12*e* and radial bearings 47 and 48. Spline sleeve 14 and outer housing 12 may be continuously formed of a single part.

Figure 6:
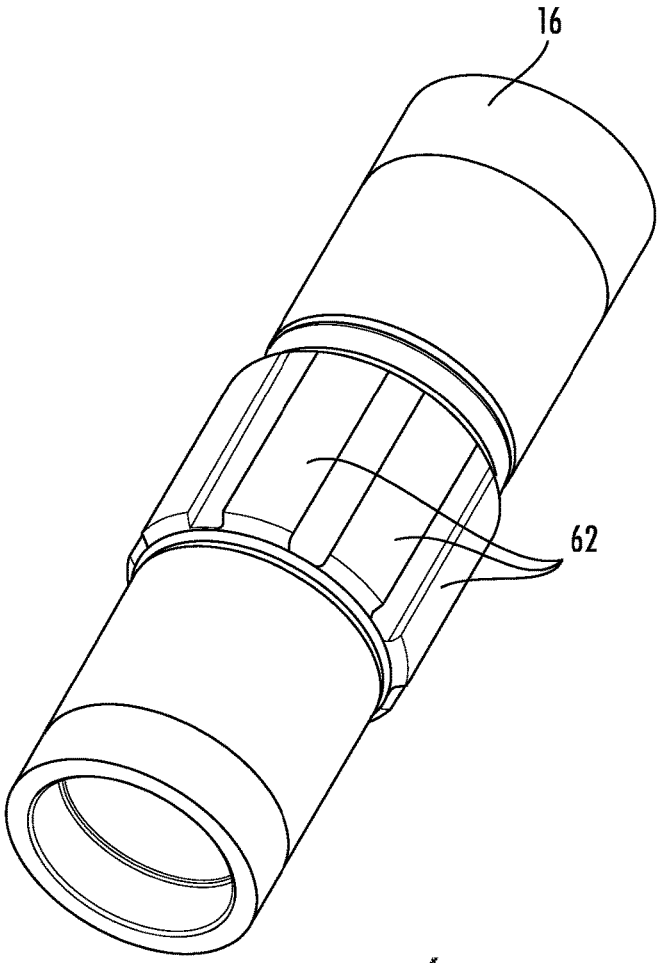
FIG. 6 is a perspective view of a shuttle of the torque adjustment assembly.
Figure 7:
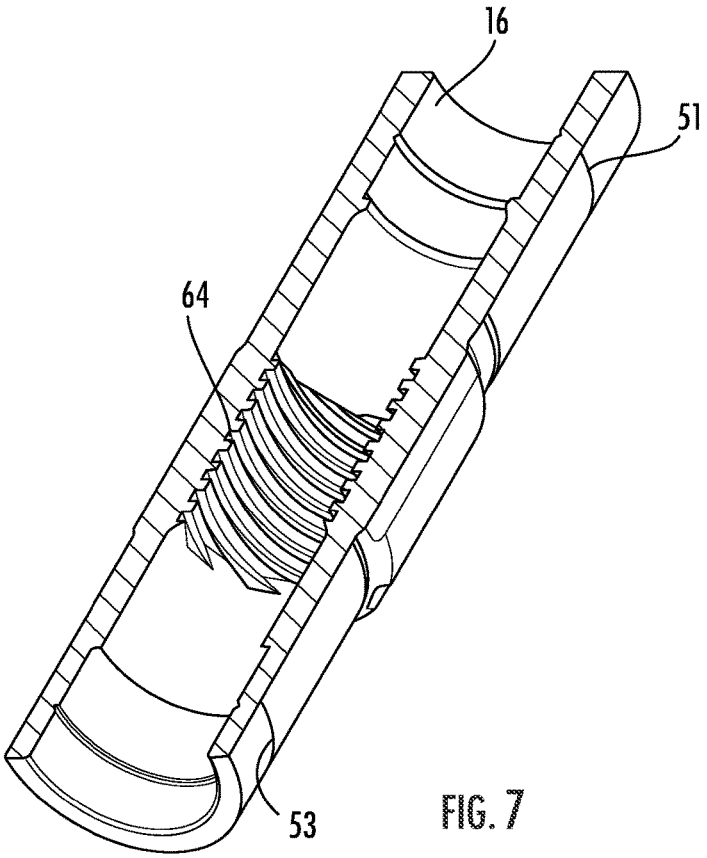
FIG. 7 is a partial perspective view of the shuttle.

With reference now to FIGS. 6 and 7, shuttle 16 may include outer splines 62 disposed on an outer surface of shuttle 16 and inner threaded surface 64. In one embodiment, inner threaded surface 64 is formed by a series of reduced diameter spiral shaped surfaces in an inner surface of shuttle 16. Alternatively, inner threaded surface 64 is formed by a series of enlarged diameter spiral shaped surfaces in an inner surface of shuttle 16. Outer splines 62 of shuttle 16 may engage inner splines 60 of spline sleeve 14 to allow shuttle 16 to slide axially relative to spline sleeve 14 while simultaneously preventing rotation of shuttle 16 relative to spline sleeve 14. Inner threaded surface 64 of shuttle 16 is configured to engage outer threaded surface 56 of mandrel 18 to allow relative rotation between shuttle 16 and mandrel 18. However, the engagement of threaded surfaces 64 and 56 only allows mandrel 18 to rotate relative to shuttle 16 if shuttle 16 moves axially relative to mandrel 18. Axial movement of shuttle 16 from the default position shown in FIG. 2 may require shuttle 16 to overcome a preset spring force of upper spring 20 or a present spring force of lower spring 28.

Figure 8:
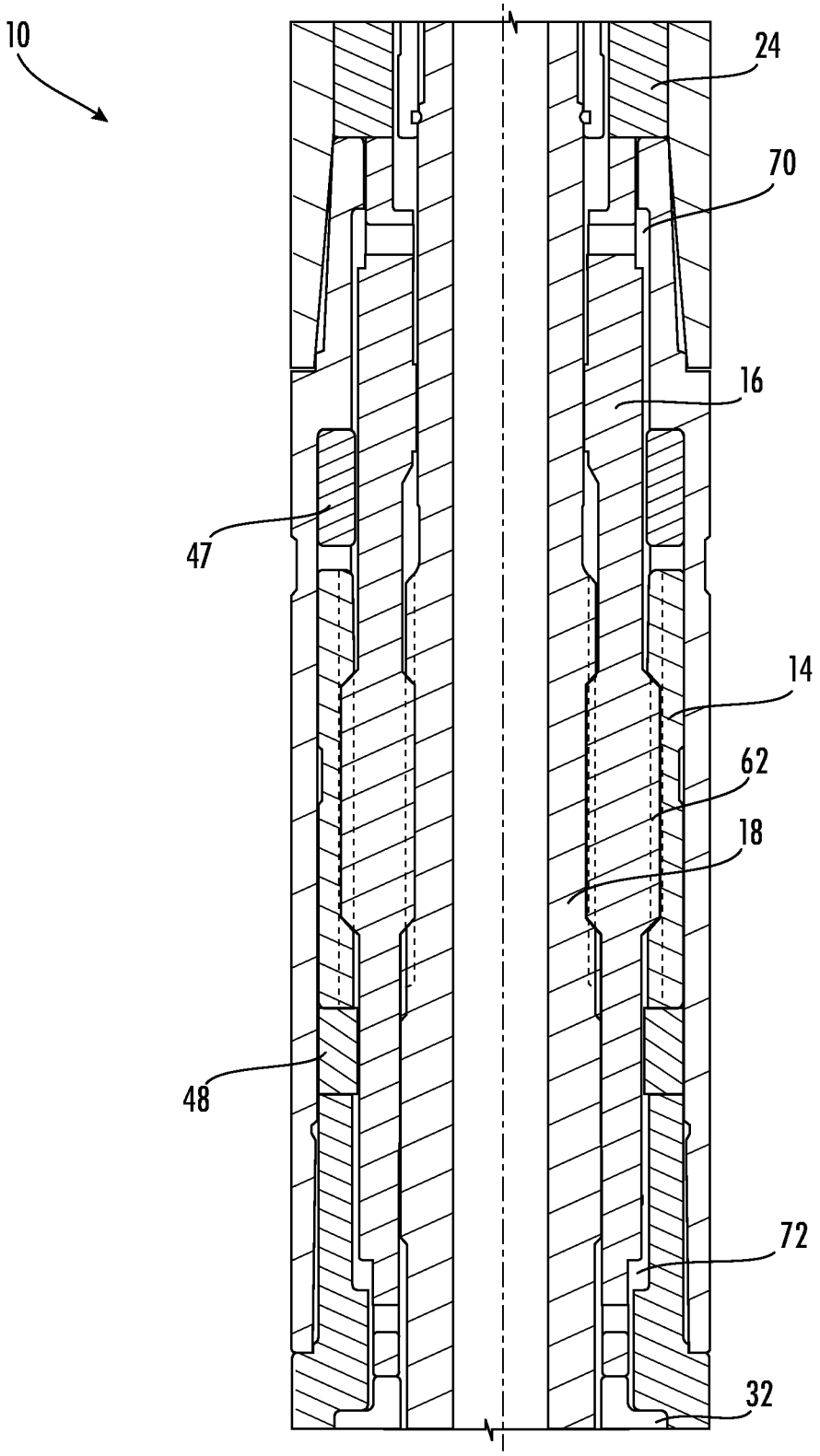
FIG. 8 is a partial sectional view of the torque adjustment assembly including an annular fluid path.

Referring now to FIG. 8, oscillation reduction tool 10 may further include an annular fluid cavity between the outer surface of mandrel 18 and the inner surfaces of spline sleeve 14 and outer housing 12. For example, upper fluid cavity 70 may be formed above splines 60 and 62, and lower fluid cavity 72 may be formed below splines 60 and 62. Fluid cavities 70 and 72 may be connected through an annular space having a restricted effective diameter. A fluid may be injected into fluid cavities 70 and 72 through a fluid port extending radially through outer housing 12, such as fluid port 73 (shown in FIG. 1). The fluid may be oil based (natural or synthetic), water based, or glycol based.

Figure 9:
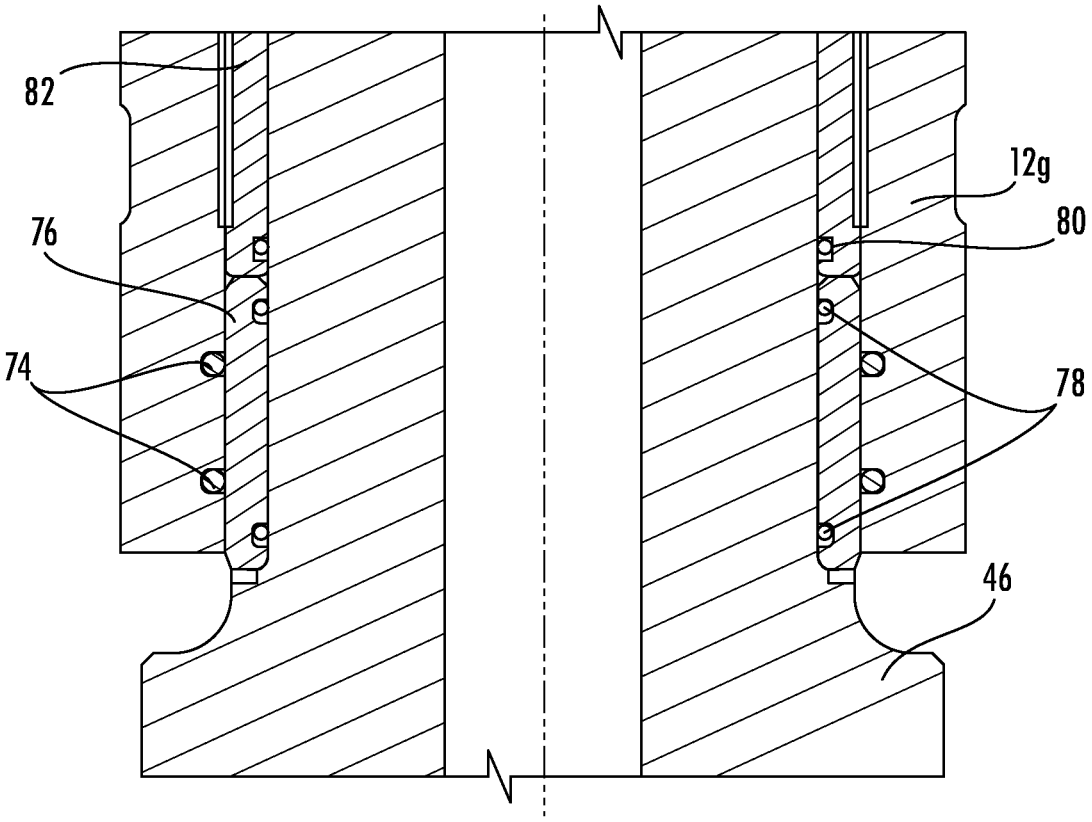
FIG. 9 is a partial sectional view of one embodiment of a fluid seal arrangement at a lower end of the oscillation reduction tool.

With reference to FIG. 9, a fluid may be retained in fluid cavities 70 and 72 by fluid seals above and below. In some embodiments, fixed seals may be positioned at lower end of outer housing 12. In one embodiment, one or more fixed seals 74 may be disposed within grooves in an inner surface of outer housing 12*g* to fluidly seal between outer housing segment 12*g* and sleeve 76. Similarly, one or more fixed seals 78 may be disposed within grooves in an inner surface of sleeve 76 to fluidly seal between sleeve 76 and lower mandrel 46. One or more fixed seals 80 may be disposed within grooves in an inner surface of sleeve 82 to fluidly seal between sleeve 82 and lower mandrel 46.

Figure 10:
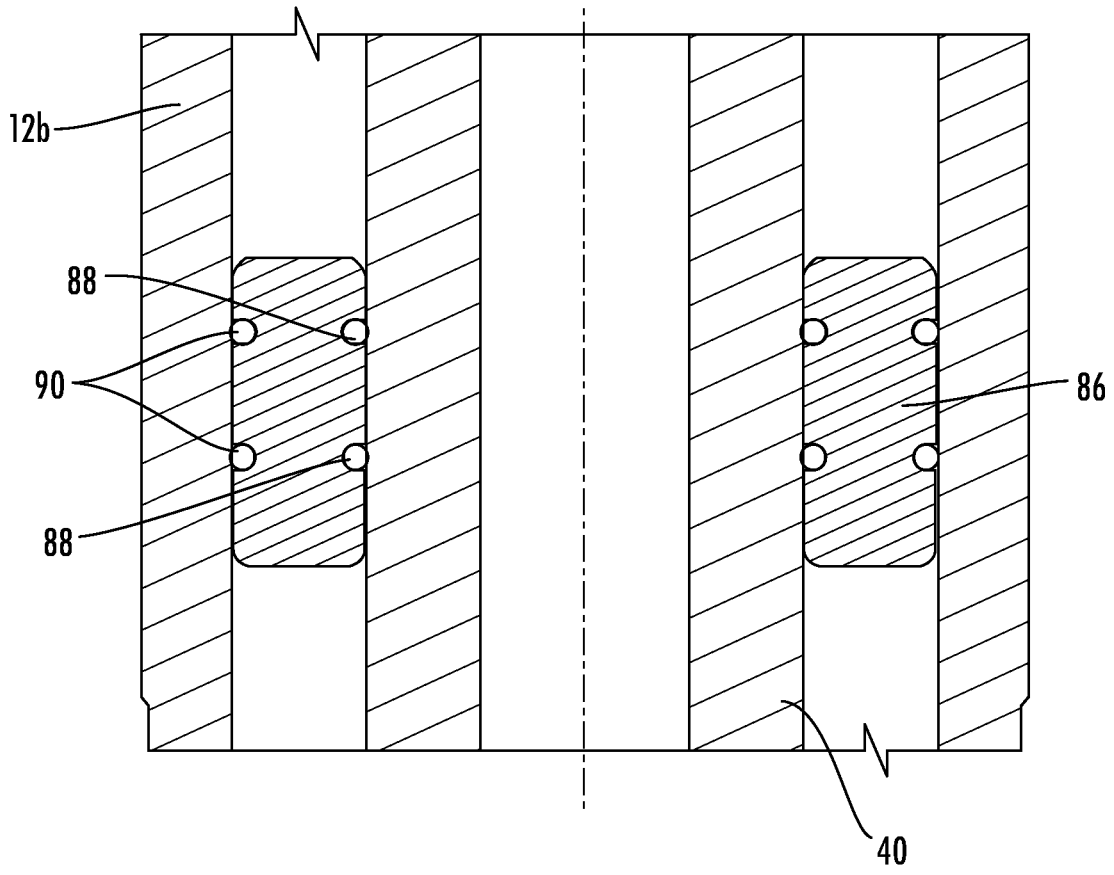
FIG. 10 is a partial sectional view of a compensating piston of the oscillation reduction tool.

With reference to FIGS. 1 and 10, compensating piston 86 may be disposed in an annular space between second upper mandrel segment 40 and outer housing segment 12*b*. Inner fluid seals 88 may be disposed within grooves in an inner surface of compensating piston 86 to fluidly seal between compensating piston 86 and second upper mandrel segment 40. Similarly, outer fluid seals 90 may be disposed within grooves in an outer surface of compensating piston 86 to fluidly seal between compensating piston 86 and outer housing segment 12*b*. Compensating piston 86, along with fluid seals 88 and 90, may provide a fluid seal for retaining a fluid within fluid cavities 70 and 72. Compensating piston 86 may be configured to slide within the annular space between second upper mandrel segment 40 and outer housing segment 12*b* to compensate for changes in the volume of fluid in fluid cavities 70 and 72. For example, as tool 10 travels deeper into a subterranean well, the higher temperature of the surrounding formation will increase the temperature of the fluid in fluid cavities 70 and 72, which may increase the volume of the fluid. In that situation, compensating piston 86 would move in an upward direction in the annular space to increase the total volume of fluid cavities 70 and 72.

Referring again to FIGS. 1 and 2, a drill string, which may include a drilling motor, disposed above oscillation reduction tool 10 may rotate outer housing 12, which may rotate spline sleeve 14 and shuttle 16. A spring strength of upper spring 20, a spring strength of lower spring 28, and the thread pitch of outer threaded surface 56 of mandrel 18 and inner threaded surface 64 of shuttle 16 may all be calibrated to cause the rotation of shuttle 16 to rotate mandrel 18 within an operating torque value range of the drilling motor. Within the operating torque value range, the torque adjustment assembly of oscillation reduction tool 10 may be in the default position shown in FIG. 2. For example, but not by way of limitation, rotation of shuttle 16 may rotate mandrel 18 within an operating torque value range of 5,000 ft-lb to 15,000 fl-lb, or any subrange therein, for a 5-inch tool.

Figure 11:
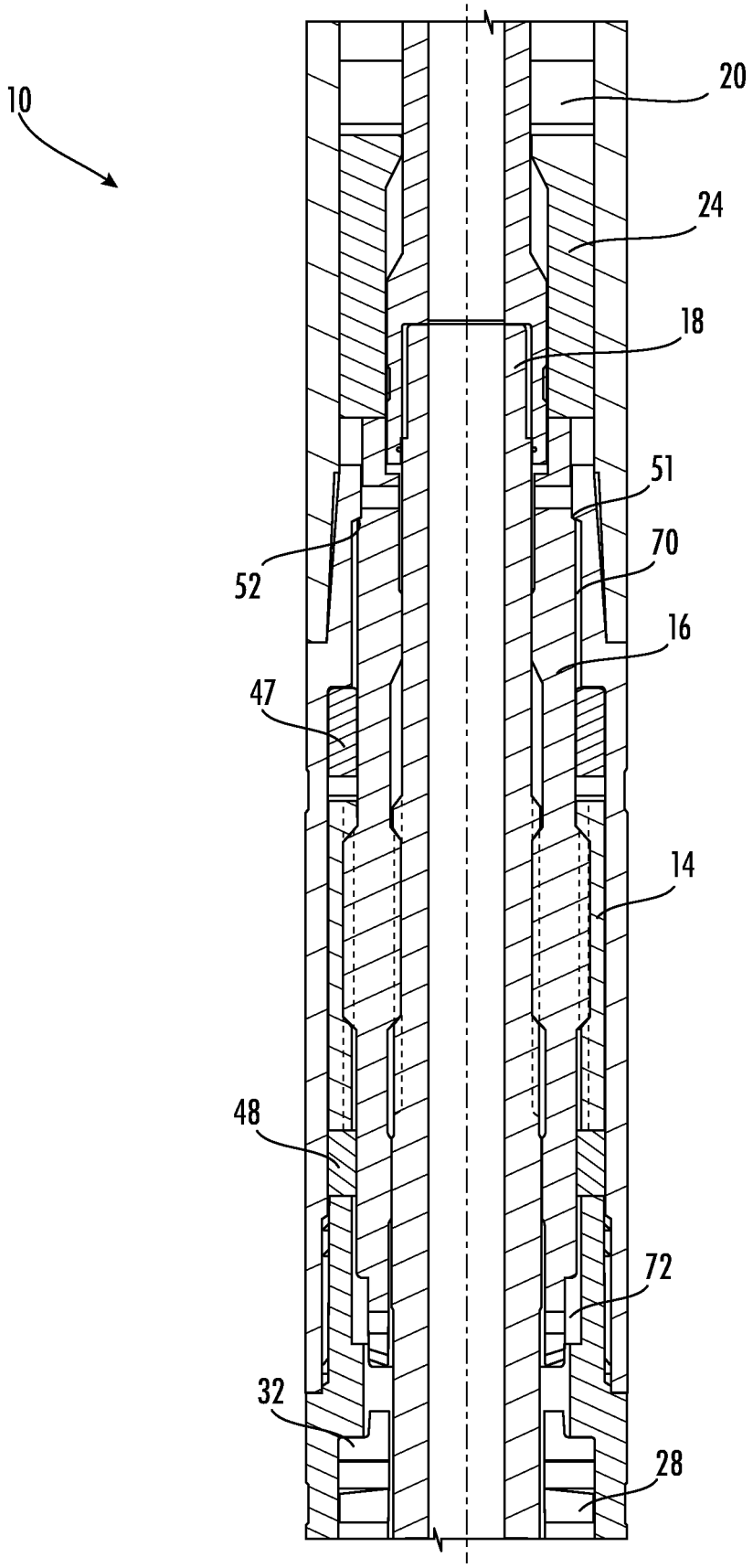
FIG. 11 is a partial sectional view of the torque adjustment assembly in an upward displaced position.

The drill bit may occasionally or frequently stop rotating due to high cutting forces between the drill bit and the subterranean formation (i.e., the drill bit is momentarily "stuck"). In conventional arrangements, the drill bit's stationary position may cause HFTO as the bottom hole assembly below the drilling motor oscillates in torsional motion between a "stuck" position and rotation. However, when utilizing the oscillation reduction tool 10, the drill string above and below tool 10 (e.g., a drilling motor and a drill bit) are torsionally connected such that any torque spikes are dampened and partially or completely absorbed by the torsion adjustment assembly in oscillation reduction tool 10. Accordingly, as shown in FIGS. 1 and 11, if the drill bit indirectly connected below lower mandrel 46 becomes momentarily "stuck," lower mandrel 46, mandrel adapter 44, mandrel 18, and upper mandrel segments 38 and 40 will all stop rotating. Because the drilling motor is a positive displacement motor, its torque output will instantly increase when the drill bit and mandrel 18 stop rotating. The greater torque output continues the rotation of outer housing 12, spline sleeve 14, and shuttle 16. Thus, during the time that the drill bit is "stuck," shuttle 16 rotates while mandrel 18 does not rotate. The rotation of shuttle 16 due to the greater torque value while mandrel 18 is stationary may cause shuttle 16 to overcome the spring force of upper spring 20 and travel axially in an upstream direction until the greater torque causes mandrel 18 and the drill bit below to rotate. As shuttle 16 travels axially in the upstream direction, upper end 26 of shuttle 16 may force upper spring block 24 in an upstream direction, thereby compressing upper spring 20 and consequently dampening the torque spike of the outer housing 12, spline sleeve 14, and shuttle 16 such that the mandrel 18 and the drill bit below experience a reduced torque spike or no torque spike at all.

Additionally, as shown in FIGS. 2, 8, and 11, in order for shuttle 16 to travel axially in the upstream direction, a volume of fluid within the upper fluid cavity 70 must flow through the restricted annular space between radial bearings 47 and 48 and shuttle 16, respectively, and through the restricted annular space between threads of shuttle 16 and threads of mandrel 18, to flow into lower fluid cavity 72. The transfer of fluid from upper fluid cavity 70 into lower fluid cavity 72 through a restricted annular space absorbs at least a portion of the mechanical energy of the HFTO. In this way, the fluid in fluid cavities 70 and 72 act as a shock absorbing mechanism to reduce the HFTO. The maximum upstream axial movement of shuttle 16 is into an upstream displaced position in which shoulder 51 of shuttle 16 engages shoulder 52 of outer housing 12, as shown in FIG. 11. The axial transfer of shuttle 16 from the default position into the upstream displaced position involves only axial movement within outer housing 12. In other words, the torque adjustment assembly of oscillation reduction tool 10 reduces the oscillation in the bottom hole assembly (e.g., above the drill bit) without changing the exterior length of the tool, thereby retaining the weight on drill bit.

Once the cutting forces that momentarily prevented the drill bit from rotating are overcome, a torque output of the drilling motor may be reduced into the operating torque value range under which shuttle 16 may axially return to the default position shown in FIG. 2 by rotating in the opposite direction relative to mandrel 18.

Figure 12:
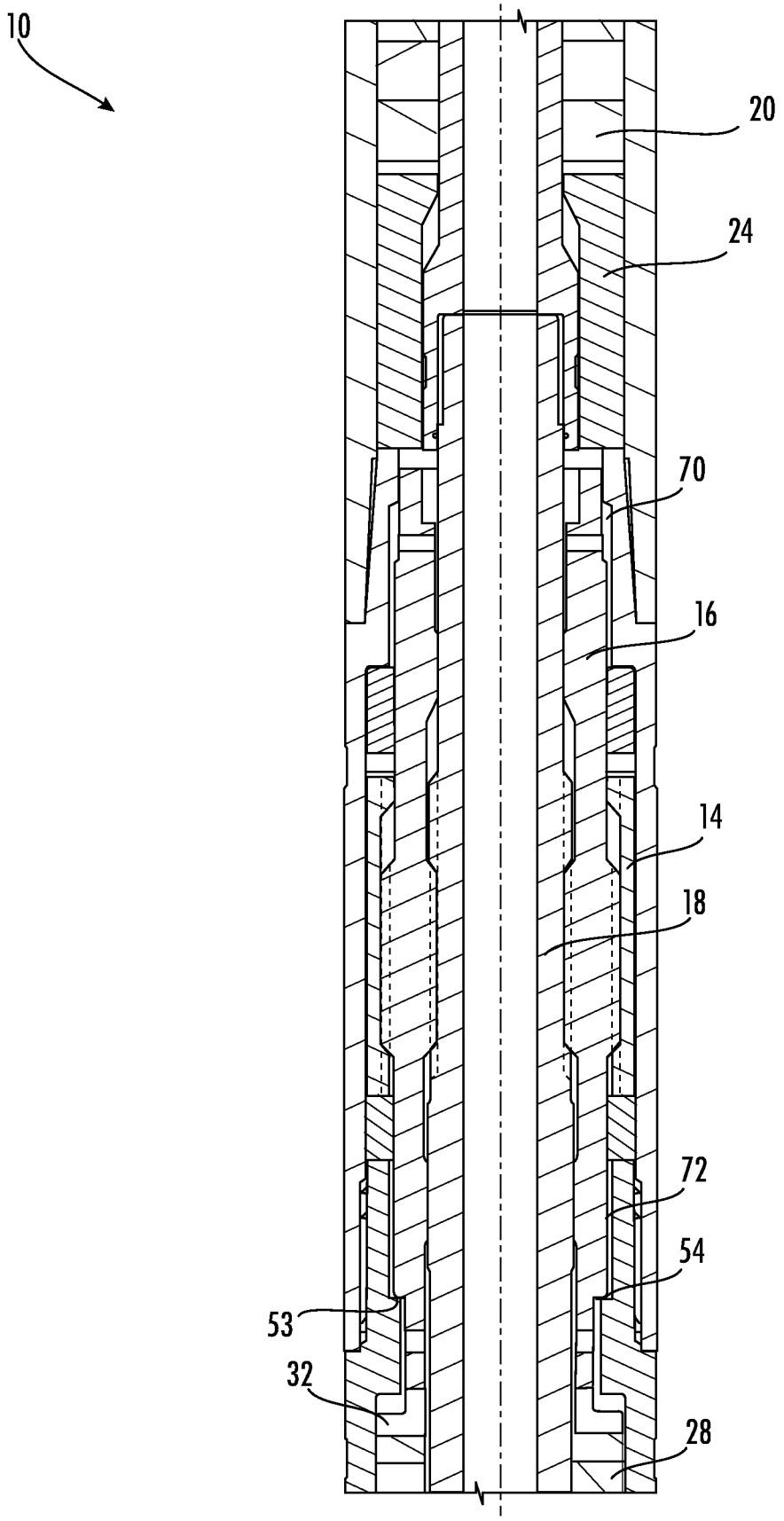
FIG. 12 is a partial sectional view of the torque adjustment assembly in a downward displaced position.

With reference to FIGS. 1 and 12, if shuttle 16 travels axially in the upstream direction and compresses upper spring 20, the whole bottom hole assembly may unintentionally be lifted, including outer housing 12 of oscillation reduction tool 10 and the drill bit. The stored spring force of compressed upper spring 20 may cause shuttle 16 to instantly travel in the downstream direction, thereby rotating mandrel 18 in the opposite direction to housing 12. As shuttle 16 travels axially in the downstream direction, lower end 34 of shuttle 16 may force lower spring block 32 in a downstream direction, thereby compressing lower spring 28 and dampening the downward speed of shuttle 16. It should be understood that a lower spring 28 is not required for drilling operations, but is useful to prevent damage to oscillation reduction tool 10 if the bottom hole assembly is unintentionally lifted off the bottom with the mud motor turning the oscillation reduction tool 10 and the upper spring 16 being compressed.

Additionally, as shown in FIGS. 8 and 12, in order for shuttle 16 to travel axially in the downstream direction, a volume of fluid within the lower fluid cavity 72 must flow through the restricted annular space between radial bearings 47 and 48 and shuttle 16, respectively, and through the restricted annular space between threads of shuttle 16 and threads of mandrel 18, to flow into upper fluid cavity 70. The transfer of fluid from lower fluid cavity 72 into upper fluid cavity 70 through a restricted annular space absorbs at least a portion of the mechanical energy stored in upper spring 20. The maximum axial downstream movement of shuttle 16 relative to mandrel 18 is into a downstream displaced position in which shoulder 53 of shuttle 16 engages shoulder 54 of outer housing 12, as shown in FIG. 12. This axial transfer of shuttle 16 from the default position into the downstream displaced position involves only axial movement within outer housing 12. In other words, the torque adjustment assembly of oscillation reduction tool 10 reduces the oscillation in the bottom hole assembly (e.g., above the drill bit) without changing the exterior length of the tool.

Figure 13:
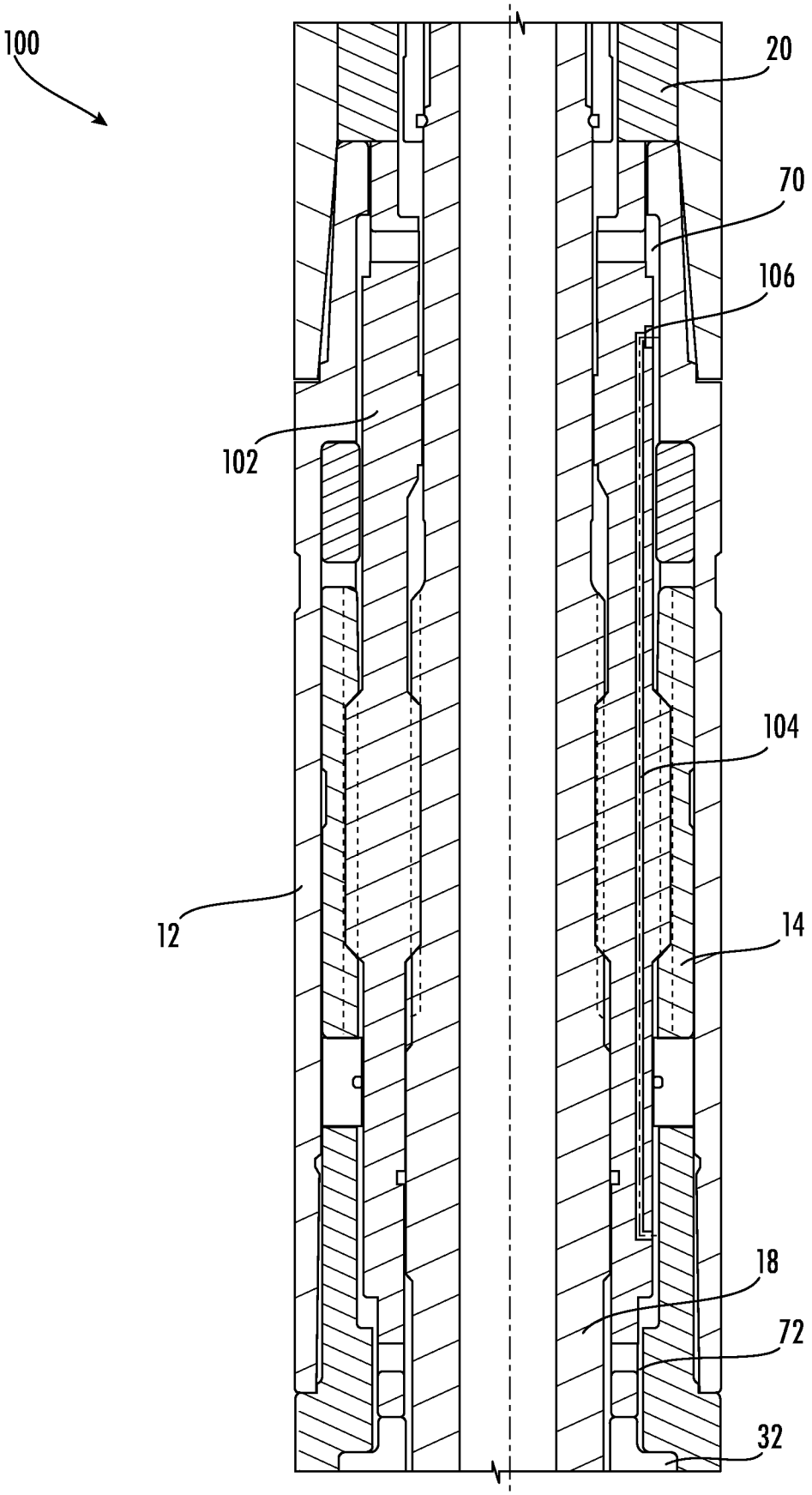
FIG. 13 is a partial sectional view of the torque adjustment assembly including a nozzle.

FIG. 13 illustrates an alternate embodiment of the oscillation reduction tool. Oscillation reduction tool 100 includes outer housing 12, spline sleeve 14, shuttle 102, and mandrel 18. Shuttle 102 may include the same features as shuttle 16. Additionally, shuttle 102 may include nozzle path 104 extending from an upper portion of shuttle 102 to a lower portion of shuttle 102. One opening of nozzle path 104 may be disposed in upper fluid cavity 70, while a second opening of nozzle path 104 may be disposed in lower fluid cavity 72. Nozzle path 104 may include a diameter restriction, such as restriction 106. Restriction 106 may be adjustable. As shuttle 102 moves axially in the upstream direction, a portion of the fluid in upper fluid cavity 70 flows through restriction 106, through nozzle path 104, and into lower fluid cavity 72. Conversely, as shuttle 102 moves axially in the downstream direction, a portion of the fluid in lower fluid cavity 70 flows through nozzle path 104, restriction 106, and into upper fluid cavity 70. This fluid flow through nozzle path 104 and restriction 106 absorbs mechanical energy caused by the HFTO. In this way, the fluid cavities and nozzle path 104 act as a shock absorbing mechanism to reduce HFTO. Except as otherwise noted, oscillation reduction tool 100 includes the same features and functions as oscillation reduction tool 10 described above.

Figure 14B:
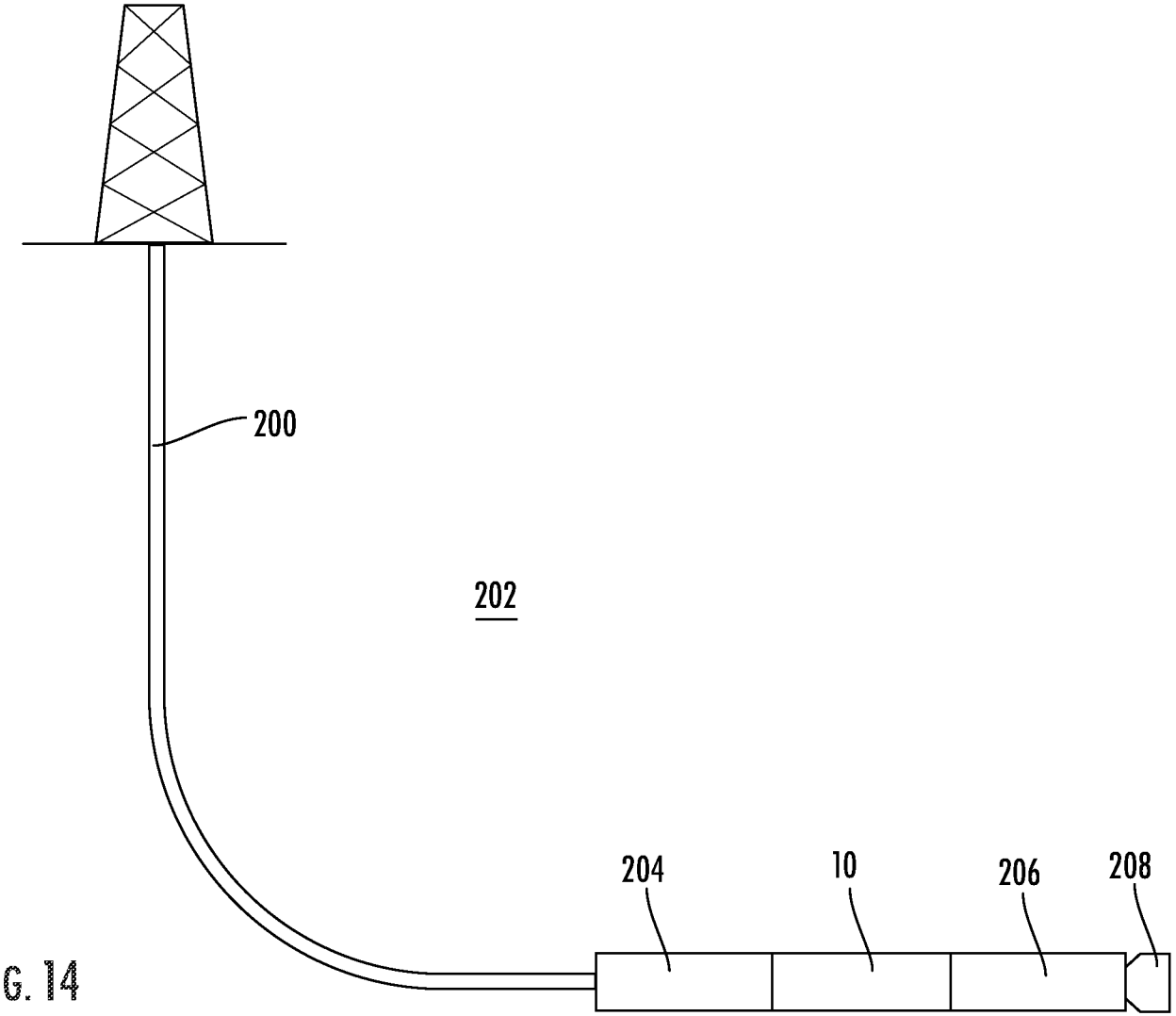
FIG. 14 is a schematic view of the oscillation reduction tool disposed within a subterranean wellbore.

With reference to FIG. 14, oscillation reduction tool 10 may be placed into wellbore 200 through subterranean formation 202 for drilling operations in the wellbore. Oscillation reduction tool 10 may be secured downstream from mud motor 204 and upstream from rotary steerable system 206 and drill bit 208. One or more additional components may be positioned between mud motor 204 and oscillation reduction tool 10 and/or between oscillation reduction tool 10 and rotary steerable system 206. If a torque output of mud motor 204 is increased above an operating torque value range, oscillation reduction tool 10 may allow internal axial movement to absorb a portion of the energy of the HFTO, thereby preventing or minimizing damage to rotary steerable system 206 without any change in the length of oscillation reduction tool 10 and maintaining weight on the drill bit.

Figure 15:
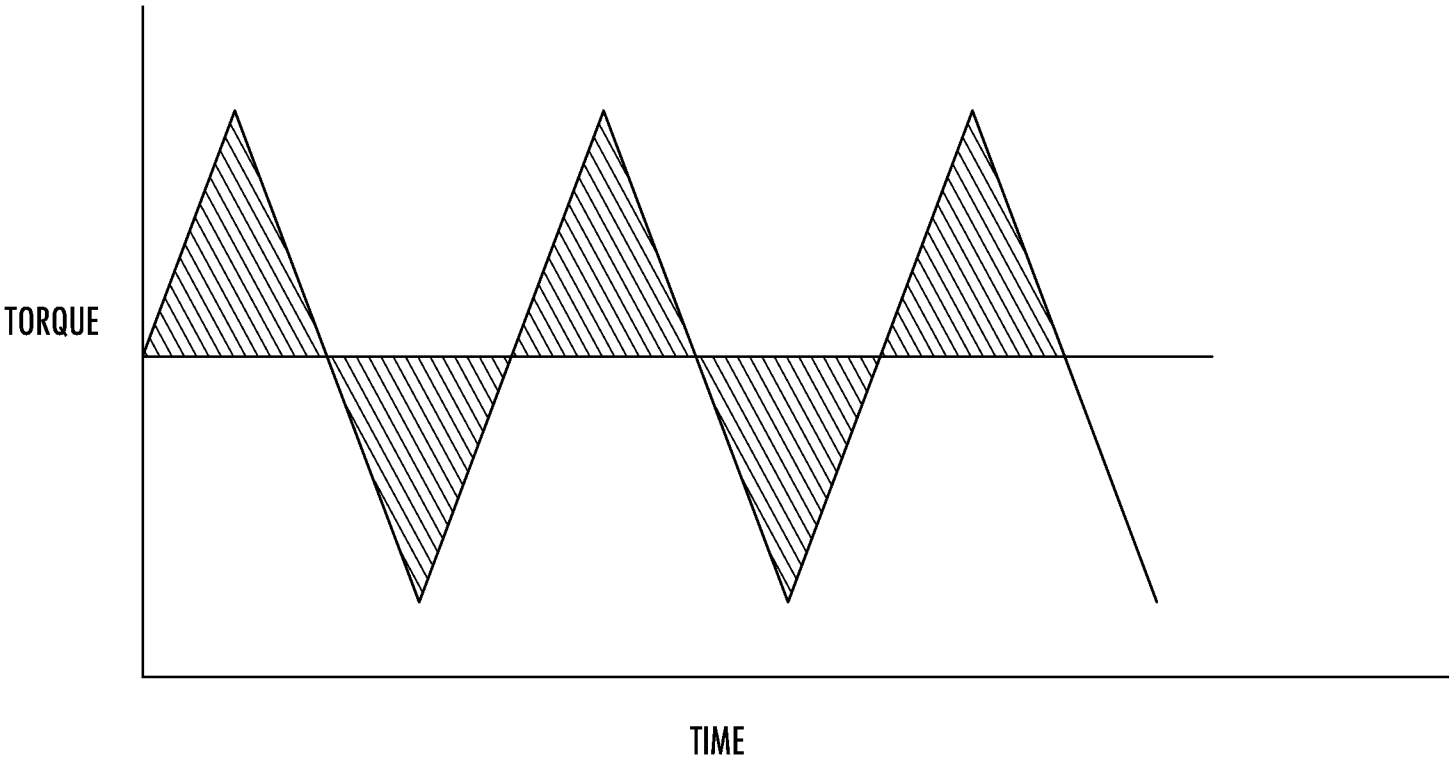
FIG. 15 (PRIOR ART)
FIG. 15 is a graphic representation of high frequency torsional oscillation over time.

FIG. 15 represents the change in torque over time when a drilling system experiences HFTO without any torque adjustment mechanism. The torque increases at a rapid pace when the drill bit is "stuck," and sharply transitions to a rapid decrease in torque. These "spikes" in torque over time cause damage to the drilling system, including the rotary steerable system.

Figure 16:
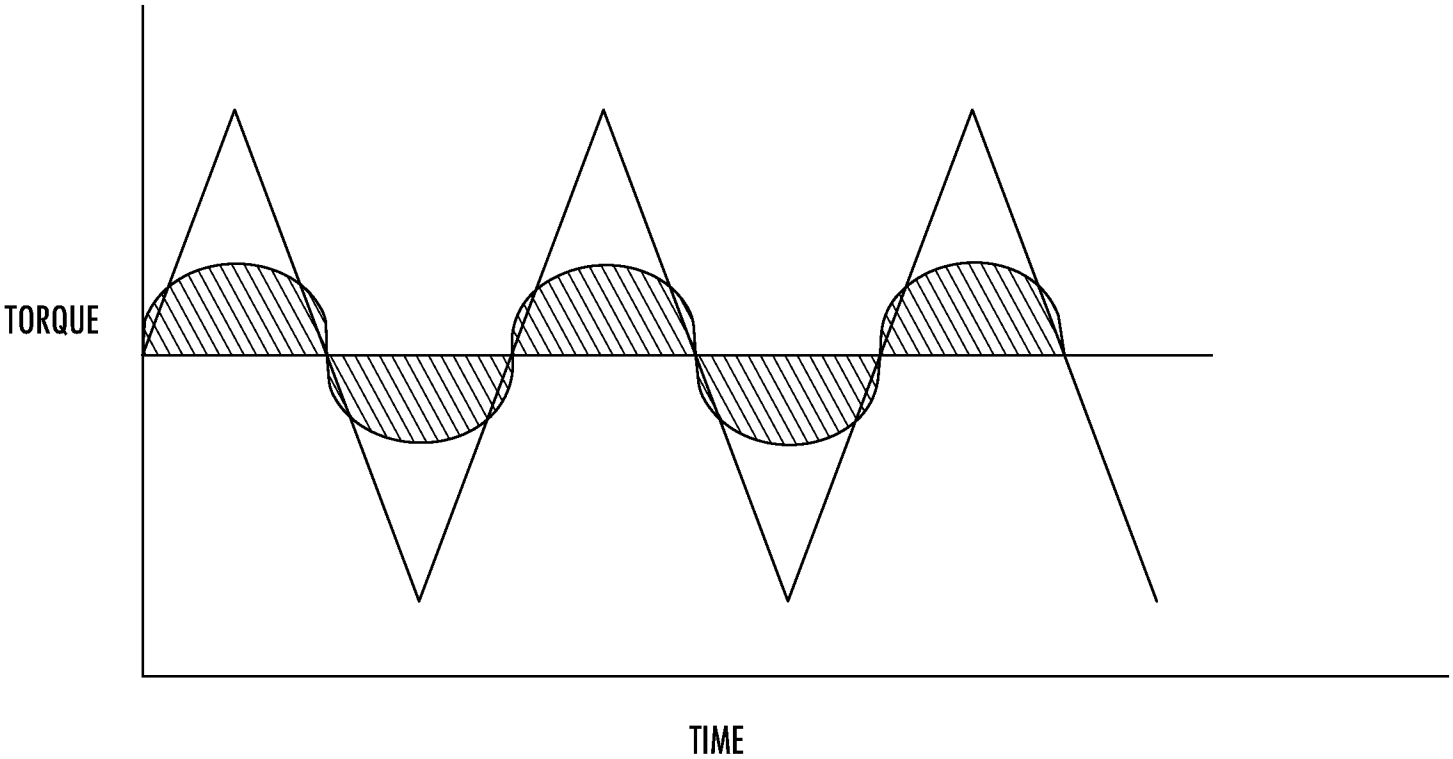
FIG. 16 (PRIOR ART)
FIG. 16 is a graphic representation of high frequency torsional oscillation with prior art devices.

FIG. 16 represents the effect of prior art torque adjustment mechanism on torque when a drilling system experiences HFTO. These prior art mechanisms "smooth" out the peaks by reducing the magnitude of the torque changes, such that the torque values change less rapidly. However, these prior art mechanism result in the same total mechanical energy change (i.e., the same area under the curve) as the drilling system experiences without any torque adjustment mechanism.

Figure 17:
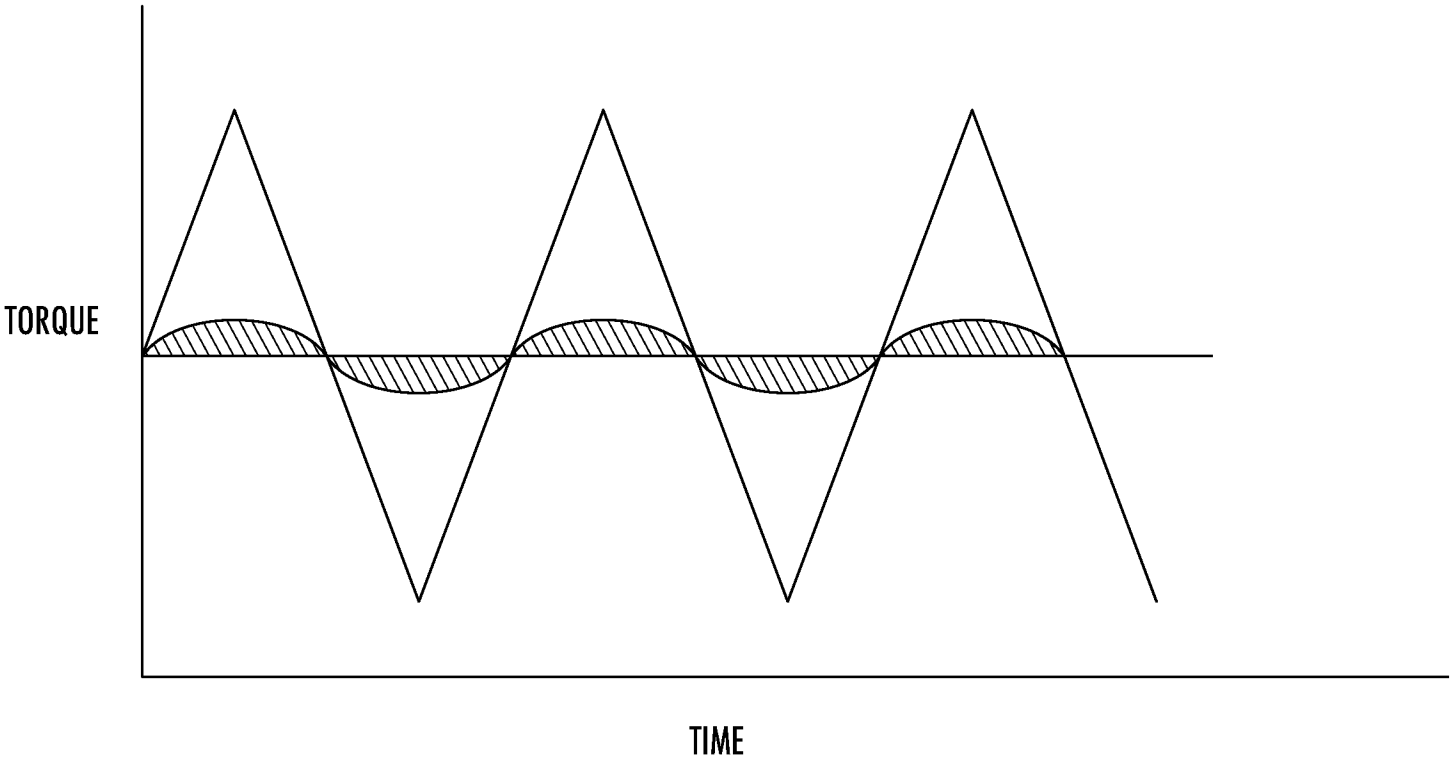
FIG. 17 is a graphic representation of high frequency torsional oscillation with the oscillation reduction tool disclosed herein.

FIG. 17 represents the effect of oscillation reduction tools 10 and 100 on torque when a drilling system experiences HFTO. As shown, tools 10 and 100 "smooth" out the peaks by reducing the magnitude of the torque change and reduce the total mechanical energy change experienced by the drilling system. In other words, oscillation reduction tools 10 and 100 reduce the area under the torque curve due to the shock absorbing effect of the fluid moving between fluid cavity 70 and fluid cavity 72 as shuttle 16 travels axially within outer housing 12 without changing the length of the tool.

As used herein, "axial" or "axially" means movement along an axis of a cylindrical tool, such as along the axis of an outer housing.

Upper and lower springs 20 and 28 may each be formed of a helical spring, a friction spring, or a Belleville spring.

Oscillation reduction tools 10 and 100 may be used without a lower spring 28. In other words, a lower spring 28 is not required for oscillation reduction tool 10 to function as described herein.

The described shock absorbing mechanism utilizing a spring arrangement in combination with a fluid flow through a restricted path can be replaced by a magnetic controlled shock absorbing mechanism or by a material dampening mechanism.

The described shock absorbing mechanism utilizing a spring arrangement in combination with a fluid flow through a restricted path can be additionally controlled by a smart fluid mechanism, such as magnetorheological (MR) fluids for active controlled dampening.

Except as otherwise described or illustrated, each of the components in this device has a generally cylindrical shape and may be formed of steel, another metal, or any other durable material. Portions of oscillation reduction tool 100 may be formed of a wear resistant material, such as tungsten carbide or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. An oscillation reduction tool, comprising:

an outer housing including a housing central bore, the outer housing having an outer surface and an inner surface;

a mandrel disposed in the housing central bore, the mandrel having an outer surface and an inner surface, the outer surface of the mandrel including a threaded section;

a shuttle disposed around a portion of the mandrel and within the housing central bore; wherein the shuttle is configured to rotate with the outer housing and to transfer a torque from the outer housing to the mandrel; wherein the shuttle is configured to selectively rotate relative to the mandrel and to selectively move axially relative to the mandrel and the outer housing to reduce an amplitude of a variation in the torque from the outer housing that is transferred to the mandrel, the shuttle having an outer surface and an inner surface, the outer surface of the shuttle including a plurality of splines, the inner surface of the shuttle including a threaded section, the threaded section of the inner surface of the shuttle cooperatively engaging the threaded section of the outer surface of the mandrel;

a spline sleeve disposed within the housing central bore and radially positioned between the outer surface of the shuttle and the inner surface of the outer housing, the spline sleeve having an outer surface and an inner surface, the inner surface of the spline sleeve including a plurality of splines, the plurality of splines of the inner surface of the spline sleeve cooperatively engaging the plurality of splines of the outer surface of the shuttle to allow the shuttle to slide axially relative to the spline sleeve while preventing rotation of the shuttle relative to the spline sleeve; and an upper radial bearing and a lower radial bearing, the upper and lower radial bearings each being disposed within the housing central bore and radially positioned between the outer surface of the shuttle and the inner surface of the outer housing; wherein the spline sleeve is axially positioned between the upper and lower radial bearings and wherein the spline sleeve is rotationally and axially fixed to the inner surface of the outer housing.

2. The oscillation reduction tool of claim 1, further comprising a bearing section, the bearing section disposed within the housing central bore and radially positioned between the outer surface of the mandrel and the inner surface of the outer housing, the bearing section configured to take up an axial load and transmit a weight of an upstream tubular string onto a drill bit operatively positioned axially below the mandrel; wherein the mandrel rotates relative to the outer housing.

3. The oscillation reduction tool of claim 1, further comprising a shock absorbing assembly disposed within the housing central bore; wherein the shock absorbing assembly is configured to reduce an amount of mechanical energy associated with the axial movement of the shuttle within the housing central bore.

4. The oscillation reduction tool of claim 3, wherein the shock absorbing assembly comprises an annular fluid cavity radially positioned between the outer surface of the mandrel and the inner surfaces of the spline sleeve and outer housing and a fluid within the annular fluid cavity, the annular fluid cavity including an annular space with a restricted inner diameter through which the fluid flows to cause a mechanical energy of a high frequency torsional oscillation to be absorbed.

5. The oscillation reduction tool of claim 1, wherein an overall length of the outer housing remains constant as the shuttle moves axially relative to the mandrel and the outer housing.

6. The oscillation reduction tool of claim 5, wherein the shuttle is configured to move axially relative to the mandrel and the outer housing when the torque applied by the outer housing is outside of a predefined torque value range.

7. An oscillation reduction tool, comprising:

an outer housing including a housing central bore, the outer housing having an outer surface and an inner surface;

a shuttle including a shuttle central bore, the shuttle having an outer surface, the outer surface of the shuttle including a plurality of splines, wherein the shuttle central bore includes an inner threaded section; wherein the shuttle is disposed within the housing central bore and configured to rotate with a rotation of the outer housing;

a mandrel including a mandrel central bore, the mandrel having an inner surface and an outer surface, the outer surface of the mandrel including a threaded section, the threaded section of the outer surface of the mandrel cooperatively engaging the inner threaded section of the shuttle; wherein the shuttle is configured to rotate the mandrel;

a spline sleeve disposed within the housing central bore and radially positioned between the outer surface of the shuttle and the inner surface of the outer housing, the spline sleeve having an outer surface and an inner surface, the inner surface of the spline sleeve including a plurality of splines, the plurality of splines of the inner surface of the spline sleeve cooperatively engaging the plurality of splines of the outer surface of the shuttle to allow the shuttle to slide axially relative to the spline sleeve while preventing rotation of the shuttle relative to the spline sleeve;

an upper radial bearing and a lower radial bearing, the upper and lower radial bearings each being disposed within the housing central bore and radially positioned between the outer surface of the shuttle and the inner surface of the outer housing;

wherein the spline sleeve is axially positioned between the upper and lower radial bearings and wherein the spline sleeve is rotationally and axially fixed to the inner surface of the outer housing;

a spring disposed within the housing central bore; the spring configured to bias the shuttle into a default position; wherein the shuttle is configured to selectively rotate relative to the mandrel and to selectively move axially relative to the mandrel and the outer housing from the default position into a displaced position by compressing the spring when a torque applied by the outer housing is outside of a predefined torque value range; and a first fluid cavity and a second fluid cavity surrounding the shuttle; wherein a portion of a fluid disposed in the first fluid cavity is displaced through a restricted area path into the second fluid cavity when the shuttle moves axially from the default position into the displaced position; wherein an overall length of the outer housing remains constant as the shuttle moves axially from the default position into the displaced position.

8. The oscillation reduction tool of claim 7, wherein the spring is a first spring and wherein the oscillation reduction tool further comprises a second spring disposed within the housing central bore; wherein the second spring is configured to bias the shuttle into the default position; wherein the shuttle is configured to move axially relative to the mandrel and the outer housing from the default position into a second displaced position by compressing the second spring when a drill bit indirectly secured below the mandrel is lifted off a bottom of a wellbore in a subterranean formation.

9. The oscillation reduction tool of claim 8, wherein the first spring and the second spring are each a helical spring, a friction spring, or a Belleville spring.

10. The oscillation reduction tool of claim 9, wherein the shuttle moves axially in an upstream direction into the displaced position and compresses the first spring when the torque applied by the outer housing exceeds the predefined torque value range; and wherein the shuttle moves axially in a downstream direction into the second displaced position and compresses the second spring when a compression force applied by the shuttle is greater than a compression force required to compress the second spring.

11. The oscillation reduction tool of claim 10, wherein the shuttle further includes an upper shoulder and a lower shoulder; wherein the axial movement of the shuttle in the upstream direction is limited by the engagement of the upper shoulder with a first shoulder of the outer housing; and wherein the axial movement of the shuttle in the downstream direction is limited by the engagement of the lower shoulder with a second shoulder of the outer housing.

12. The oscillation reduction tool of claim 7, further comprising an upper fluid seal and a lower fluid seal configured to seal the first fluid cavity and the second fluid cavity.

13. The oscillation reduction tool of claim 12, wherein the upper fluid seal or the lower fluid seal includes a compensating piston.

14. The oscillation reduction tool of claim 7, further comprising a bearing section, the bearing section disposed within the housing central bore and radially positioned between the outer surface of the mandrel and the inner surface of the outer housing, the bearing section configured to take up an axial load and transmit a weight of an upstream tubular string onto a drill bit operatively positioned axially below the mandrel.

15. A method of reducing torsional oscillation for drilling assemblies, comprising the steps of:

a) providing an oscillation reduction tool, comprising: an outer housing including a housing central bore, the outer housing having an outer surface and an inner surface; a mandrel disposed in the housing central bore, the mandrel having an outer surface and an inner surface, the outer surface of the mandrel including a threaded section; and a shuttle disposed around a portion of the mandrel and within the housing central bore; wherein the shuttle is configured to rotate with the outer housing and to transfer a torque from the outer housing to the mandrel; wherein the shuttle is configured to selectively rotate relative to the mandrel and to selectively move axially relative to the mandrel and the outer housing to reduce an amplitude of a variation in the torque from the outer housing that is transferred to the mandrel, the shuttle having an outer surface and an inner surface, the outer surface of the shuttle including a plurality of splines, the inner surface of the shuttle including a threaded section, the threaded section of the inner surface of the shuttle cooperatively engaging the threaded section of the outer surface of the mandrel; a spline sleeve disposed within the housing central bore and radially positioned between the outer surface of the shuttle and the inner surface of the outer housing, the spline sleeve having an outer surface and an inner surface, the inner surface of the spline sleeve including a plurality of splines, the plurality of splines of the inner surface of the spline sleeve cooperatively engaging the plurality of splines of the outer surface of the shuttle to allow the shuttle to slide axially relative to the spline sleeve while preventing rotation of the shuttle relative to the spline sleeve; and an upper radial bearing and a lower radial bearing, the upper and lower radial bearings each being disposed within the housing central bore and radially positioned between the outer surface of the shuttle and the inner surface of the outer housing; wherein the spline sleeve is axially positioned between the upper and lower radial bearings and wherein the spline sleeve is rotationally and axially fixed to the inner surface of the outer housing;

b) securing the oscillation reduction tool in a drill string; wherein the outer housing of the oscillation reduction tool rotates with a rotation of the drill string above the oscillation reduction tool; and wherein the drill string below the oscillation reduction tool rotates with a rotation of the mandrel of the oscillation reduction tool;

c) dampening any torque spikes from the drill string and the outer housing that are transferred to the mandrel and the drill string below the oscillation reduction tool by axially moving the shuttle relative to the mandrel and the outer housing.

16. The method of claim 15, wherein the oscillation reduction tool further comprises a shock absorbing assembly disposed within the housing central bore; wherein the shock absorbing assembly is configured to reduce an amount of mechanical energy associated with the axial movement of the shuttle within the housing central bore; and further comprising the steps of:

d) reducing the mechanical energy of a torsional oscillation from a drilling motor to a drill bit with the shock absorbing assembly of the oscillation reduction tool.

17. The method of claim 15, wherein in step (b) the outer housing rotates with a rotation of a drilling motor secured above the oscillation reduction tool in the drill string, and a drill bit secured below the oscillation reduction tool in the drill string rotates with a rotation of the mandrel.

18. The method of claim 17, wherein in step (b) a rotary steerable system is secured between the oscillation reduction tool and the drill bit.

* * * * *